United States Patent [19]

Iwanaga

[11] Patent Number: 4,975,579

[45] Date of Patent: Dec. 4, 1990

[54] DISCHARGE ELEMENT AND APPARATUS TO WHICH THE SAME IS APPLIED

[76] Inventor: Masao Iwanaga, 7-603, 17, Nishiogiminami 2-chome, Suginami-ku, Tokyo, Japan

[21] Appl. No.: 263,008

[22] Filed: Oct. 26, 1988

[30] Foreign Application Priority Data

Oct. 30, 1987 [JP] Japan ..... 62-274834

[51] Int. Cl.[5] ..... H01T 19/00

[52] U.S. Cl. ..... 250/324; 361/230

[58] Field of Search ..... 250/324, 325, 326; 346/159; 361/230

[56] References Cited

U.S. PATENT DOCUMENTS

| | | | |
|---|---|---|---|
| 3,937,960 | 2/1976 | Matsumoto | 250/324 |
| 4,056,723 | 11/1977 | Springett et al. | 250/324 |
| 4,334,144 | 6/1982 | Ferrarini | 250/324 |
| 4,652,318 | 3/1987 | Masuda et al. | 250/324 |
| 4,779,107 | 10/1988 | Weisfield et al. | 346/159 |

*Primary Examiner*—Jack I. Berman

*Attorney, Agent, or Firm*—Price, Heneveld, Cooper, DeWitt & Litton

[57] ABSTRACT

A discharge element for use in charging or discharging fine particles, charging or discharging a photoconductive insulating film applied to electronic copying machine, surface treatment for plastic, and generation of ozone from oxygen or the like. An electrically conductive metal such as aluminum or the like is metal sprayed to the surface of a thin-plate like ceramic insulating body so that an electrically conductive power supplying line is formed. A coated electrode of a high melting point semiconductor is metal sprayed on the outer surface of the power supplying line so that a combined linear electrode is formed. Next, on the reverse side of the thin-plate like ceramic insulating body there is provided an electrically conductive planar electrode by metal spraying. A high potential AC power source is connected between the combined linear electrode and the planar electrode so that AC silent creeping discharge is generated adjacent to the coated electrode and the surface of the insulating body.

26 Claims, 13 Drawing Sheets

DISCHARGE ELEMENT AND APPARATUS TO WHICH THE SAME IS APPLIED

BACKGROUND OF THE INVENTION

1. Industrial Field of the Invention

The present invention relates to a discharge element to be used in charging or discharging fine particles, charging or discharging photoelectrically conductive insulation film used in electronic copying machines, surface treatments of plastics, and generation of ozone from oxidants The present invention further relates to a discharge apparatus having a structure that combines such a discharge element with the power source for the same, and also relates to a discharge treatment apparatus having a structure that combines the above-described discharge apparatus with an auxiliary electrode, a power source and a device for handling a subject 2. Description of the Related Art A conventional element for use in the above-described types of applications comprises an electrically conductive strip electrode mainly comprising a metal provided on the surface of a ceramic insulating body with a planar electrode provided on the inside of the former. Therefore, when a high frequency, silent creeping discharge is generated on the surface of such a ceramic insulating body during the application of high frequency voltage, the strip electrode is partially consumed and is thus deformed to take an irregular shape, or a part of the body thereof may be melted and splashed over the surface of the ceramic insulation body, causing the electrical field to be disordered. This causes its efficiency as an ion source to deteriorate. These phenomena can also result from oxidation of the surface of the electrode and the thus-generated oxide exhibits a low melting point. These phenomena can also occur because the oxidation products are chemically unstable.

A so-called grading method is known as a method to prevent the above-described problems, wherein both the surface of the liner electrode and the same of the ceramic insulating body are sealed with a molten glass coat. However, if the thickness of the coat is too thin, the glass coating is subject to premature breakdown. On the other hand, if the glass coating is too thick, the insulating characteristics of the grading layer prevent the generation of sufficient ions, thus requiring the application of a rather high voltage in comparison to the case where no grading is performed. In addition, the melting point of the grading layer is not sufficiently high to prevent generation of fine particles from the grading layer when discharge is performed. Therefore, when such discharge element is used in gas treatment, the treatment gas generated is contaminated by the above-described fine particles, causing the quality of the subject to be critically affected. In particular, when ozone is generated using ferment as a material by a conventional discharge element for the purpose of using it to manufacture semiconductor products, boron, which is contained in a grading material applied on alumina generally used as a ceramic insulating material of a discharge element, contaminates gas containing generated ozone. The thus-contaminated ozone can critically affect the quality of the semiconductor products.

In addition, a known method is employed in which fine ceramics represented by 92% or more alumina is used as the insulating material, and in order to form an electrically conductive strip electrode on the surface of the fine ceramics in an integrated manner with it and to form a planar electrode on the inside of the same also in an integrated manner, the two electrodes are printed by a thick-film technique in a green sheet process. Then, they are press-welded to each other before being baked in a hydrogen atmosphere for a certain long time period so as to be metalized for the purpose of manufacturing a thick-film multilayered printed ceramic substrate. In the thus-manufactured discharge element, the thermal expansion coefficient of the alumina fine ceramics which serves as the insulating material and that of the material for the electrodes are made approximately the same in a significantly wide temperature region from room temperature to approximately 1500 degrees C. Therefore, materials other than paste mainly made of tungsten cannot be used as the material for the electrodes. However, since tungsten displays relatively poor resistance against oxidation at high temperatures, a problem arises in that the electrodes are consumed by oxygen usually contained in an atmosphere for cases where the discharge element is used. As a result of this, performance cannot be stably maintained through a long time period. Furthermore, in the known method of manufacturing discharge elements for the above-described thick-film multilayered printed ceramic substrates, semiconductor ceramics are used as the material for electrodes. However, if the material for the electrodes is replaced by a semiconductor, heating occurs at the electrode or the voltage of the electrode resistor drops since semiconductors literally offer a great electrical resistance. As a result of this, the voltage which is applied to the electrode disposed away from the power supplying portion is reduced, causing the efficiency to deteriorate. Consequently, an electrical field apparatus which can be put into practical use cannot be obtained. Furthermore, the above-described manufacturing methods suffer from the critical disadvantages that they need expensive manufacturing facilities, and require a lengthy processing to complete the products. Therefore, the manufacturing costs with the above-described methods become great.

An object of the present invention is to overcome the above-described problems experienced with the conventional discharge elements. That is, an object of the present invention is to prevent occurrence of phenomena that a linear electrode is consumed and is thus deformed to take an irregular shape, or the same splashes and adheres to the surface of the ceramic insulating material.

Another object of the present invention is to avoid a necessity of raising the voltage to be applied even if a film is formed on the surface of such linear electrode so as to improve the durability of it.

A further object of the present invention is to reduce the manufacturing cost by simplifying the manufacturing method for the discharge element, and to make the types of the materials capable of being used various in accordance with the object of use for the purpose of widening the application scope for the discharge element.

SUMMARY OF THE INVENTION

The present invention relates to a discharge element having a high-melting point semiconductor linear electrode thereof including a conductive body power supplying line therein, and relates to a method of cheaply quantity-manufacturing the same; the high-melting point semiconductor linear electrode comprising an electrically conductive linear electrode and a planar electrode which sandwiches an insulating body such as ceramics, glass, crystalized glass, and enamel, which are called a ceramic insulating material. The present invention includes a discharge apparatus having a structure that combines such a discharge element with the power source for the same, and also relates to a discharge treatment apparatus having a structure that combines the above-described discharge apparatus with an auxiliary electrode, a potential determining power source and a device for handling a subject.

When a high potential AC voltage power source is connected and a high potential AC current is applied via a ceramic insulating body between a planar electrode having a high electrical conductivity and a linear electrode including a power supply line and having a surface comprising a high melting point semiconductor, an AC silent creeping discharge occurs on the surface of the ceramic insulating material between the two electrodes and adjacent to the linear electrode, this discharge being generated relative to this linear electrode. Therefore, a great quantity of monopolar ions are discharged from the above-described discharging region. As a result of this, charging the fine particles or films can be efficiently performed, or a great quantity of monopolar ions are discharged in such a manner that the polarity of the is alternated for the purpose of performing discharge of articles. Furthermore the quality of the surface or the fine particles can be improved by treating articles in this discharging region, or a chemical reaction, for example, oxidation of oxygen, can be performed by a gas reaction in this discharging region.

In these cases, although the linear electrode becomes the central portion of the high frequency silent creeping discharge and is thereby subjected to crushes of ions or electrons due to strong electrical field, the linear electrode is not consumed due to its excellent chemical stability and durability resulting from a structure wherein the coated electrode comprises a high melting point semiconductor made of a mixture or a compound mainly comprising titania, chromia, silicon carbide, zirconia, or ceria. Furthermore, since the coated electrode on the surface of the line electrode is 1 to 300 $\mu$m thick, its surface, which displays the various electrical conductivity of the above-described various semiconductors, assuredly becomes the same potential as the inner conductive body power supplying line which usually comprises a cheap metal such as aluminum, nickel, stainless steel, and nichrome. Therefore, even in a case of an excessively lengthened linear electrode, only one power supplying point needs to be provided for the purpose of supplying electricity to the entire body of the line electrode. The above-described type of high melting point semiconductors exhibits a sufficient hardness against damage, but presents a problem in that it is too brittle. By coupling it to a metal serving as the inside power supplying line, the mechanical characteristics on the whole are altered so that it cannot be easily damaged and broken. As a result of this, practical characteristics are obtained because the electrodes therein can be easily handled at the time of assembling or maintenance.

DESCRIPTION OF THE PREFERRED EMBODIMENTS

Figure 1:
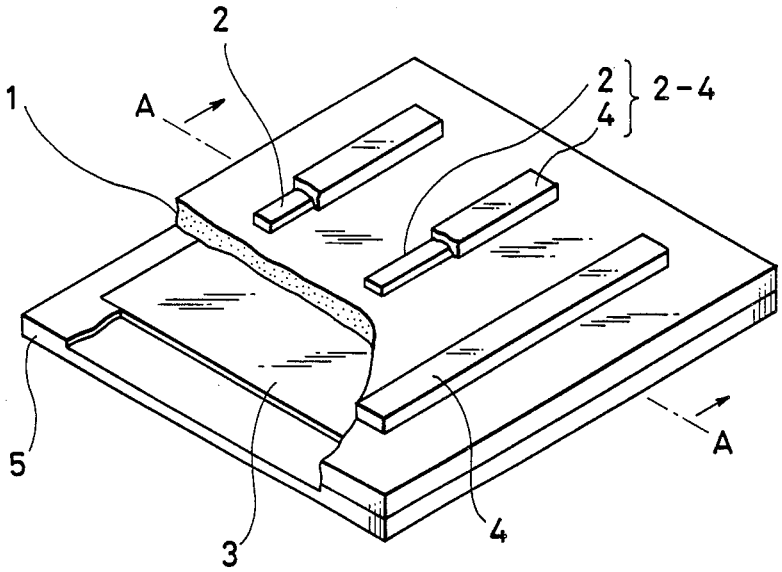
FIG. 1 is a perspective view of a discharge element according to the present invention from which a part is omitted.
Figure 2:
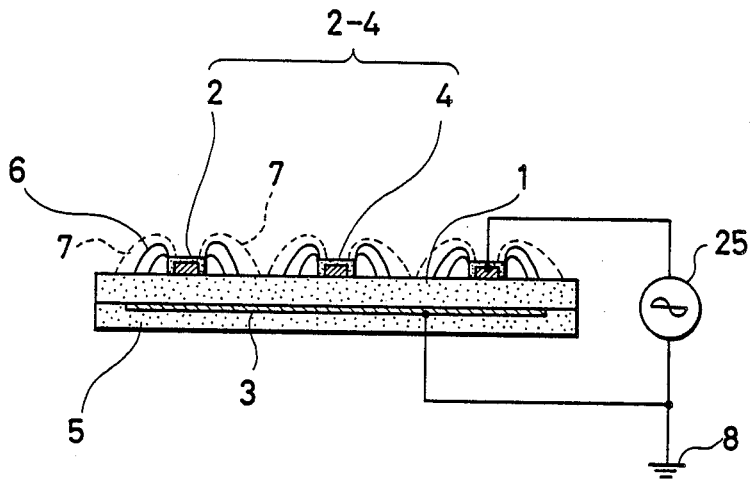
FIG. 2 is an enlarged cross-sectional view of FIG. 1.

As shown in FIGS. 1 and 2, a plurality of electrically conductive power supplying lines 2 adhered to a ceramic insulating body 1 are, in parallel to each other, formed by spraying aluminum, aluminum alloy, nickel, nichrome, or stainless steel, using a masking, to the surface of a thin-plate like ceramic insulating body 1 such as a high purity alumina substrate. Outside it, linear electrodes 4 are formed by metal spraying or the like so as to be a combined strip electrodes 2–4, the linear electrodes 4 comprising a high melting point semiconductor made of a mixture or a compound mainly comprising titania, chromia, silicon carbide, zirconia, or ceria. Next, on the reverse side of the thin plate-like ceramic insulating body 1 and on the opposing side to the above-described electrically conductive linear electrode, an electrically conductive planar electrode 3 is formed by metal spraying or the like. Furthermore, a protective insulating layer 5 to protect planar electrode 3 is, as needed, provided.

When the thus constituted structure is used as the discharge apparatus, an AC high potential power source 25 is, as shown in FIG. 2, connected between the above-described power supply line 2, that is, the combined linear electrodes 2–4 and the planar electrode 3. Then, high voltage AC current is applied between the surface of the coated electrode 4 and the planar electrode 3 so that an electrical field 6 (designated by an electric lines of force) is created. As a result of this, AC silent creeping discharge is generated in a region 7 surrounded by a dashed line disposed near the surface of the coated electrode 4 and the insulating body 1, causing for improvement in the surface by making plastic present in this region, or ions to be discharged to be used to perform charging or discharging. A further variable application can be achieved such as generating oxygen or ozone due to the discharge chemical reaction generated in this region. The discharging current at this time is passed between the surface of the coated electrode 4 and the surface of the insulating body 1 due to the discharge, and the same is supplied to the surface of the coated electrode 4 from the overall length of the power supplying line 2 via the thickness of the high melting point semiconductor coated electrode 4. The power supplying line 2 is usually designed in such a manner that a plurality of them are disposed in parallel to each other. In this case, it is so arranged that the potential is the same by a connection (omitted from the illustration). The combined linear electrodes 2–4 may be used solely, this being within the scope of the present invention.

The discharge element according to the present invention is not limited within the above-described embodiment, but can be applied to the various modifications to be described hereinafter. The material for the ceramic insulating body can comprise fine ceramics such as alumina, zirconia, glass, crystallized glass and enamel, each having excellent insulating characteristics and in the form of a thin plate-like shape of a ceramic taken in a broad sense. They can be selected to be used corresponding to the objects intended The shape of the same usually is in the form of a flat plate or a cylinder. Furthermore, if necessary to meet a particular use, the other shape, that is, an insulating ceramic in the form of a curved surface, can be employed The planar electrode only need to be in the form of a plane positioned in contact close to the insulating ceramic thin plate and to be a shape that can be recognized as a plane in the electrostatics view point Therefore, a net shaped electrode or a strip electrode corresponding to the conductive linear electrode is often used. In addition to the method of manufacturing in which metal is sprayed to the reverse side of the thin plate-like insulating ceramics, electrically conductive paste may be baked using a thick film technique, or electrically conductive paint may be applied to it. The protective insulating layer disposed on the reverse side of the planar electrode may be coated with a different material, for example, silicone resin, after the planar electrode has been formed. Furthermore, the ceramic insulating layer may be formed by metal spraying. Since these methods are all cold processes that are different from the method of integrally forming electrodes used in the method of thick film technique for multilayered metalized substrates, such planar electrodes and the protective insulating layer can be formed at a significantly high speed and a low cost regardless of the difference in the thermal expansion coefficient between the ceramic and the material for the electrode. In addition, the planar electrode 3 and the protective insulating layer 5 may be integrally manufactured with the ceramic insulating body 1 using the method of manufacturing multilayered ceramic metalized substrate.

Since the method of forming the power supplying line 2 for the discharge element according to the present invention employs metal spraying which is a cold manufacturing method, significant advantages can be obtained such as high speed machining and flexible selecting capability for the material in the thermal expansion coefficient viewpoint. Therefore, substantially all of the metal materials can be usually employed. Furthermore, it exhibits a low cost and an advantage can be obtained in that the surface roughness suitable for the ensuing formation of the high melting point semiconductor coated electrode can be immediately obtained without the necessity of additional working. Furthermore, the usual manufacturing methods such as thick film technique, a CVD method and a PVD method employed at the time of manufacturing ceramic printed substrate can be employed. A metal spraying method is an advantageous method when the high melting point semiconductor coated electrode 4 is manufactured since the melting point of the material is rather high. In addition to it, another method such as ceramic coating, a PVD method and a CVD method classified in the thick film technique can be employed.

Figure 3A:
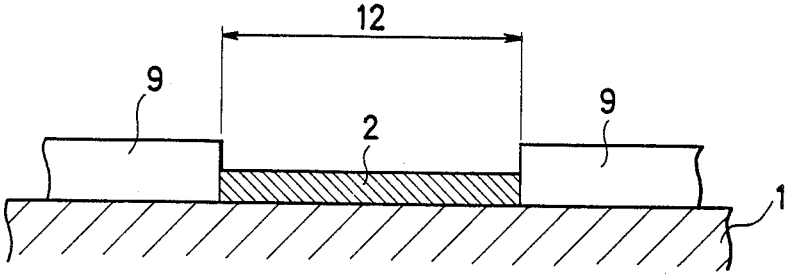
FIGS. 3A, 3B, 3C, 4A, 4B, 4C and 4D illustrate the method of manufacturing the discharge element illustrated in FIG. 2.
Figure 3B:
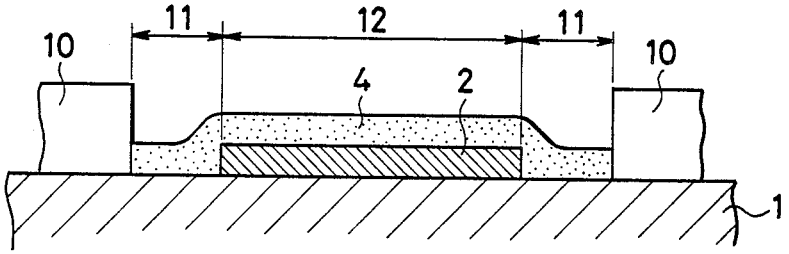
Figure 3C:
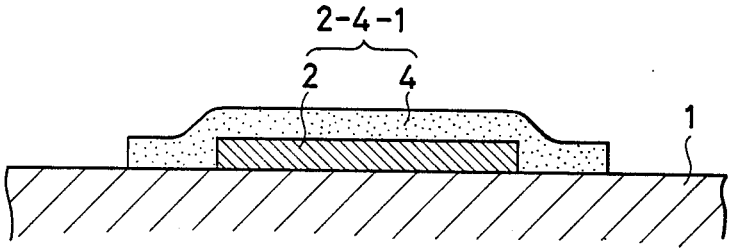
Figure 4A:
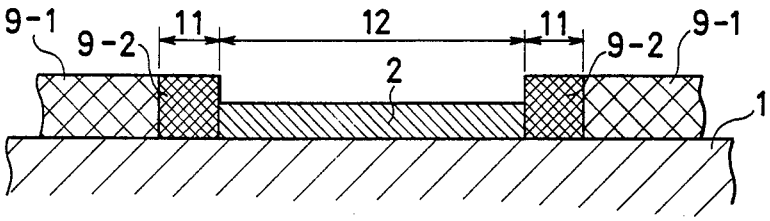
Figure 4B:
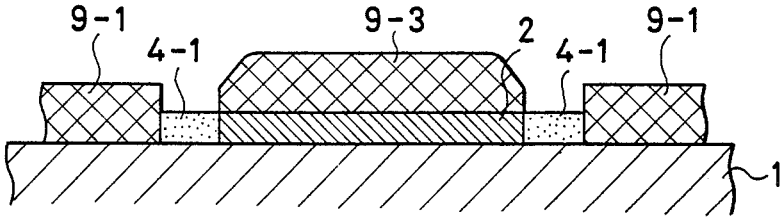
Figure 4C:
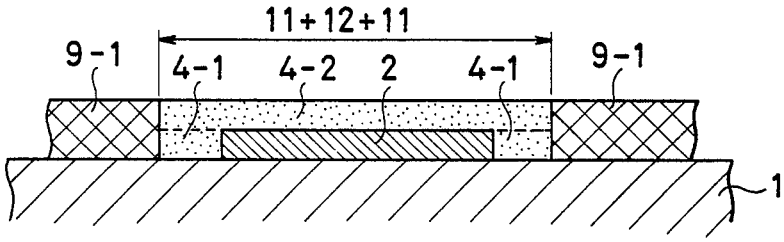
Figure 4D:
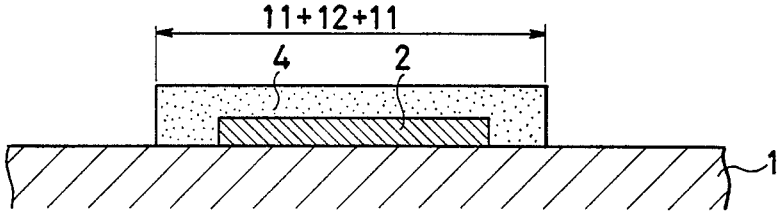

When the shape and the dimensions of the electrode are defined at the time of forming the power supplying line 2 and the high melting point semiconductor coated electrode 4, a masking method is usually employed. Referring to FIG. 3A, masking materials 9 are disposed sandwiching the width 12 in which the electrically conductive power supplying line 2 is to be formed, and the electrically conductive power supplying line 2 is formed by metal spraying or the like. Next, as shown in FIG. 3B, the masking materials 10 are disposed away from each other by the widthwise distance $11+12+11$, and the high melting point semiconductor coated electrode 4 is, as described above, formed by metal spraying or the like. As a result of this, a high melting point semiconductor combined linear electrode 2-4-1 including the electrically conductive power supplying line 2 according to the present invention is formed as shown in FIG. 3*c* in which the cross-sectional shape of the same is illustrated. Since the end portion of the thus-formed electrode serving as the central portion of discharge is relatively thin with respect to the thickness of the central portion of the same, the width 11 at the end portion sometimes needs to be uniformly and accurately finished in order to improve the performance and the durability of the element. The method of manufacturing combined linear electrode having the uniform thickness from the end portion to the central portion is shown in FIG. 4.

Referring to FIG. 4, masking is performed in such a manner that inner masking materials 9-2 of the width 11 respectively which corresponds to the half width of the difference in width between the power supplying line 2 and the high melting point semiconductor coated electrode 4 are disposed on both inside portions of the masking materials 9-1 of the width $11+12+11$ where the high melting point semiconductor coated electrode is to be formed. The thus-arranged masking is, as shown in FIG. 4A, provided on the surface of the ceramic insulating body 1, and the power supplying line 2 is formed by, as described above, metal spraying or the like. Next, the inner masking materials 9-2 are removed so that the exposed surfaces of the ceramic insulating bodies each having a uniform width are assuredly formed on both sides of the power supplying line 2. By forming the high melting point semiconductor electrode, as described above, on the exposed surface by metal spraying or the like, the combined strip electrodes each having the cross-sectional shape shown in FIG. 3 (FIG. 3—3) can be formed. When the high performance combined strip electrodes having the cross-sectional shape as shown in FIG. 4D are formed, a masking material 9-3 of substantially the same width as the power supplying line 2 which has been previously formed is, as shown in FIG. 4B, formed on the power supplying line 2 after the inner electrodes 9-2 have been removed. Then, high melting point semiconductor coated films 4-1 are each formed between the masking material 9-1 and the previously-formed power supplying line 2 in such a manner that the height of it is substantially the same as that of the power supplying line 2. Next, as shown in FIG. 4C, the masking material 9-3 is removed, and a high melting point semiconductor film 4-2 is formed through the width 11+12+11, and is integrated with the previously-formed film 4-1. As a result of this, a high performance and sufficiently durable electrode can be industrially manufactured, it being formed as shown in FIG. 4D in such a manner that the end portion and the central portion thereof have the same thickness. The dimensions of the electrode is usually arranged in such a manner, as shown in FIG. 4C, that the width 11+12+11 is 0.5 to 1.5 mm, the width 11 is 0.1 to 0.25 mm, and the thickness of the overall body of the electrode is 0.02 to 0.2 mm. Since a multiplicity of the thus-arranged electrodes are usually in parallel structure for use, the method and apparatus for speedily manufacturing the combined strip electrode described in detail in FIGS. 4 and 3 with a low cost contributes significantly to the industrial field.

Although, in the above-described embodiments, all of the cases start at a ceramic insulating thin plate without exception when the discharge element according to the present invention is manufactured, the present invention is not limited to the above descriptions That is, various modifications can be performed within the basic concept of the present invention, the various modifications being such as that a member such as metal plate or a metal cylinder each exhibiting mechanical strength is used as the planar electrode, and a ceramic insulating layer is formed on the above-described member by metal spraying, enamel formation or ceramic coating or the like and, next, the combined linear electrode is formed.

Figure 5:
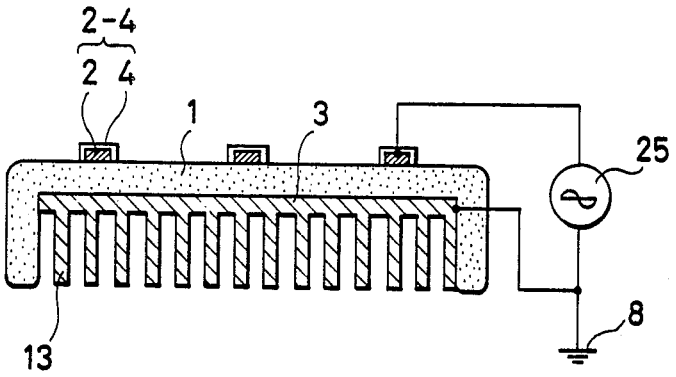
FIGS. 5 to 10 are cross-sectional views illustrating a state according to an embodiment where the discharge element according to the present invention is subjected to a gas-reaction treatment apparatus.
Figure 6:
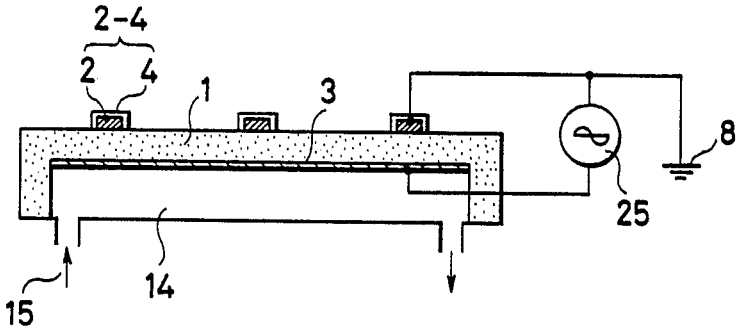

In the discharge apparatus such as that shown in FIG. 2 in which the discharge element according to the present invention is connected with a high potential AC power source, a part of the operating electricity becomes necessarily thermal energy. Therefore, a heat radiation means becomes necessary. If the apparatus is small in size, natural heat radiation from the whole body of the discharge element is, as shown in FIG. 2, sufficiently effective, while if the apparatus has a relatively great capacity, a heat radiation means is usually disposed adjacent to the planar electrode 3. The heat radiation means may be disposed adjacent to the planar electrode 3 through the protective insulating layer 5. Another way is, as shown in FIG. 5, to make the whole body of the planar electrode serve as a heat radiation device 13. A further modified way is to provide, as shown in FIG. 6, a cooling-down chamber 14 adjacent to the planar electrode so as to perform heat radiation. As the refrigerant, either a gas or fluid may be use.

In the discharge apparatus according to the present invention, the planar electrode 3 to which the high potential AC power source is connected or the combined linear electrodes 2–4 may be, as shown in FIGS. 2 and 5, grounded 8. The structure wherein the planar electrode 3 is grounded 8 is often used for generating ozone or the like. In a case where humans or articles can easily touch the combined linear electrodes 2–4, the combined linear electrodes 2–4 may be grounded 8.

Figure 7:
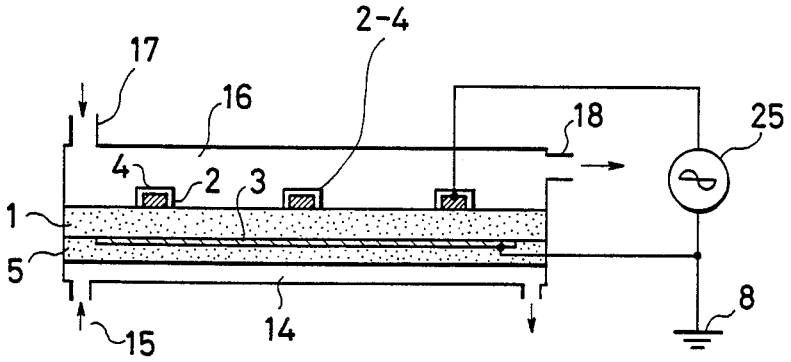
Figure 8:
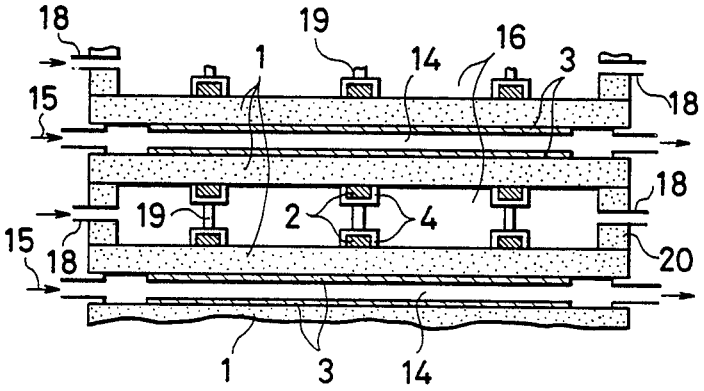
Figure 9:
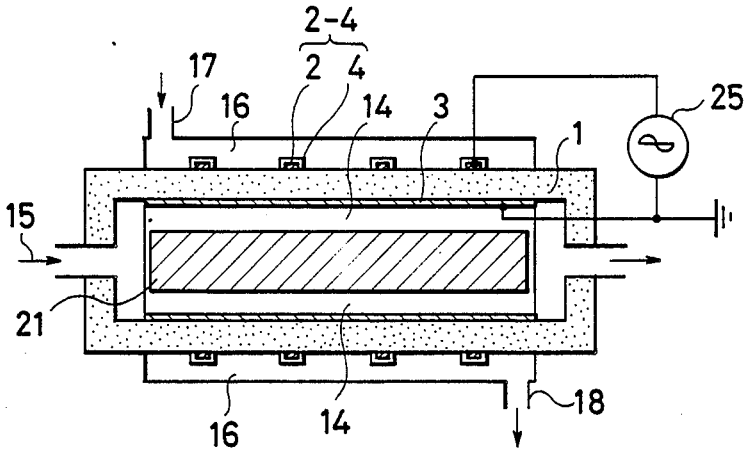
Figure 10:
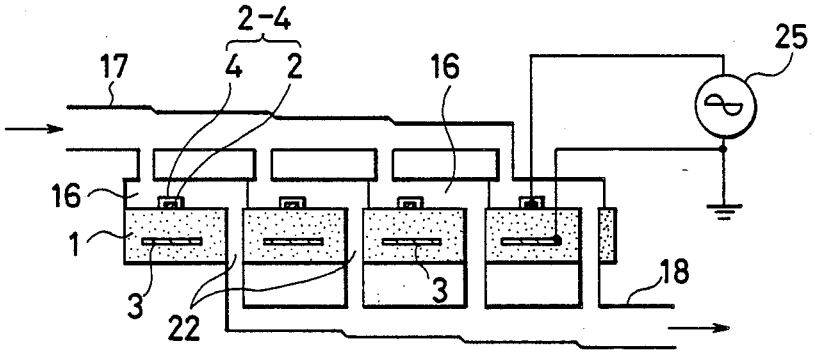

When the discharge apparatus according to the present invention is utilized to deodorize the atmosphere or the like, the only necessity is to dispose the discharge element during operation at the place to be deodorized or the like after necessary measures for preventing an electrical shock. However in a case where the same is used for the purpose of preparing ozone or the like, it is preferable to form a gas discharge treatment apparatus so that only processed gas is separated and captured, this gas discharge treatment apparatus being structured in such a manner, as shown in FIG. 7, that a discharge chamber 16 having an inlet port 17 and an outlet port 18 is provided on the surface of the ceramic insulating body on which the combined linear electrodes 2–4 are disposed. Reference number 14 represents a cooling-down chamber. FIG. 8 illustrates an embodiment of the present invention in which a multilayered structure is formed by using an insulating body 1 so as to constitute the discharge chambers 16 and the cooling-down chambers 14. If necessary, spacers 20 are provided for the side walls and spacers 19 are provided for the discharge chambers 19. In this case, if the mechanical strength of the discharge element according to the present invention is given by the planar electrode 3, the discharge chambers 16 and the cooling-down chambers 14 may be alternately formed using mainly the planar electrode 3. This type of structure is included in the scope of the present invention. The spacers 19 for the discharge chambers need to be provided at the necessary places and by the necessary numbers. The power source and connection are omitted from FIG. 8. FIG. 9 illustrates an example of an embodiment to form the discharge chambers 16 and the cooling-down chambers 14 when the discharge element is in the form of a cylinder. The spacer 21 is used for the purpose of adjusting the flow velocity of the refrigerant. As a modification of this, the present invention can be achieved by disposing the combined linear electrode 2–4 on the inside of the cylindrical insulating body 1, while the planar electrode 3 is disposed outside the cylindrical insulating body 1. In this case, cooling-down may be performed by a cooling-down fan or a similar method in addition to the provision of the cooling-down chamber. If the discharge element according to the present invention is designed to be in the form of a cylinder or the approximate shape for the purpose of forming the gas discharge treatment apparatus, a structure can improve the efficiency of the apparatus, the structure being formed in such a manner that the treatment gas or refrigerant is introduced in the tangetial direction to the discharge element, and, if necessary, discharge is similarly performed. The application of the above-described type of means is included in the scope of the present invention. FIG. 10 illustrates another embodiment of the gas discharge treatment apparatus according to the present invention. The insulating body 1 is provided with connecting holes 22 connecting the surface of the combined linear electrodes 2–4 with the reverse side of the same at the places needed to be provided. The treatment gas is introduced through an inlet port 17, and the gas which has been treated after it has been distributed to each of the electrodes is gathered through the connecting holes 22, and is discharged through an outlet port 18. Thanks to the thus-formed structure, gas treatment conditions can be precisely controlled.

Figure 11A:
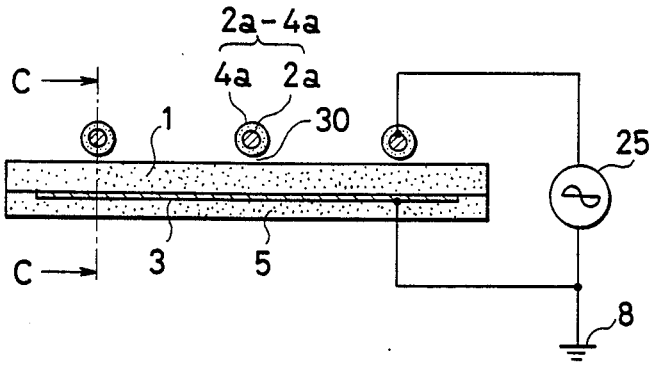
FIGS. 11 to 15 are enlarged cross-sectional views of a discharge element and discharge apparatus according to another embodiment of the embodiment shown in FIG. 2.
Figure 11B:
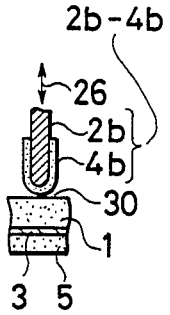
Figure 12A:
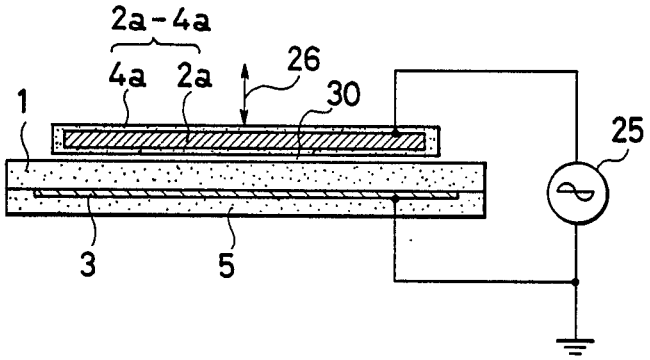
Figure 12B:
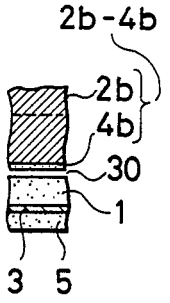
Figure 13:
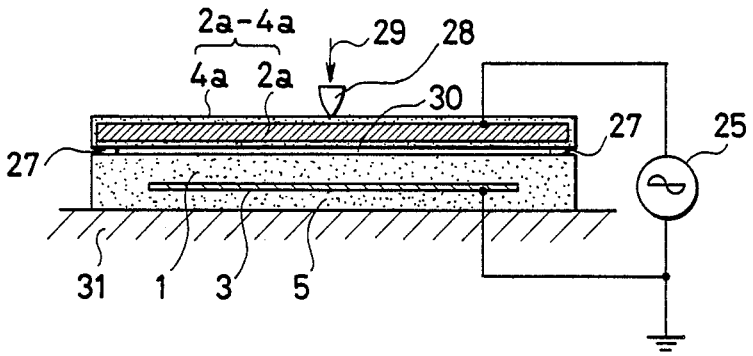

FIG. 11 illustrates another example of a discharge element and a discharge treatment apparatus which uses the former according to the present invention. FIG. 12 mainly illustrates the cross-sectional shape taken along the line C—C in FIG. 11A. Referring to FIGS. 11 and 12, the combined wire electrode *2a–4a* comprises an inside power supplying line *2a* and high melting point semiconductor coated electrode *4a* which covers the former. This combined wire electrode *2a–4a* is disposed on the surface of the ceramic insulating thin plate 1 at a gap 30. The planar electrode 3, protective insulating layer 5, power source 25 and connection are structured similarly to those in the embodiments shown in FIGS. 1 to 10. In the discharge element according to this embodiment, since the diameter of the combined electrode 2a to 4a can be reduced by using a metal wire for the power supplying line 2a, discharge igniting voltage can be reduced so that stage discharges can be obtained by a widely distributed voltages. For example, when it is applied to an ozone generating apparatus, the quantity of ozone generated can be stably and widely adjusted by the voltage. Furthermore, the strength distribution of the discharge over the lengthwise direction of the combined wire electrode 2a–4a can be favorably uniform. In the embodiments shown in FIGS. 11A to 12A, the intensity of discharge can be widely adjusted with a constant voltage of the power source 25 by adjusting, as shown by an arrow 26 in FIG. 12, the gap 30 between the surface of the linear electrode 2a–4a and that of the insulating thin plate 1. If the gap is made zero, that is, the combined wire electrode 2a to 4a is brought into contact with the surface of the insulating thin plate 1, the intensity of discharge can be widely adjusted by changing the voltage. Since the electrical bonding of the wire electrode 2a–4a to the surface of the insulating thin plate 1 is weak even if the gap is zero, the discharge element according to this embodiment of the present invention exhibits a significant characteristic that even if the humidify of the treatment gas becomes high, the rise in the discharge igniting voltage is limited to low. The discharge element may be formed similarly to that of the embodiments shown in FIGS. 11A and 12A in such a manner that an electrically conductive thin plate or blade-like power supplying line 2b, whose cross-sectional shape is shown in FIGS. 11B and 12B, are used as an alternative to the wire supplying line 2a shown in FIGS. 11A. Furthermore, a combined thin blade electrode 2b–4b is constituted b forming a high melting point semiconductor coated electrode 4b at the front end point of the electrically conductive thin plate or blade-like power supplying line 2b. In this case, a significant advantage can be obtained such that the combined thin blade electrode 2b–4b gives a great mechanical strength, causing for adjusting the gap 30 and assembling the whole element body to become easy. This type of structure comprises an important embodiment of the present invention. The combined wire electrode 2a–4a shown in FIGS. 11A and 12A and the combined blade-like electrode 2b–4b shown in FIGS. 11B and 12B to be called a "wire electrode" hereinafter. FIG. 13 illustrates another structure to adjust the gap 30 between the combined wire electrode 2a–4a and the surface of the ceramic insulating thin plate 1. The thin plate 1 is designed so as not to be deformed even if the same is secured to a fitting frame 31 and is applied with a force. A spacer 27 is disposed between the combined wire electrode 2a–4a and the thin plate 1 so as to make the gap 30 constant in this state. Next, a voltage causing weak and uniform discharge is applied between the two electrodes by the power source. When the intensity of discharge is intended to be enlarged, a slight displacement 29 is added by a displacement member 28 to the combined wire electrode 2a–4a so as to continuously change the gap 30 so that the intensity of discharge can be continuously and widely adjusted.

Figure 14:
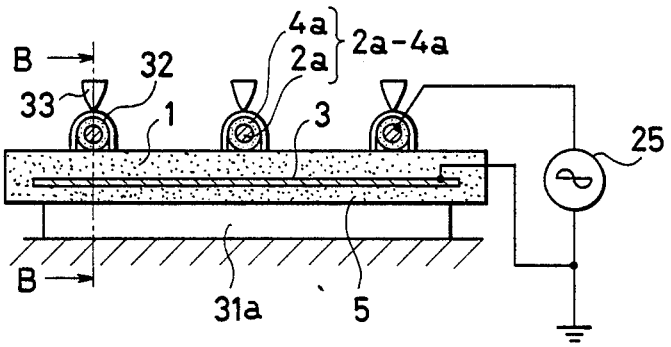
Figure 15:
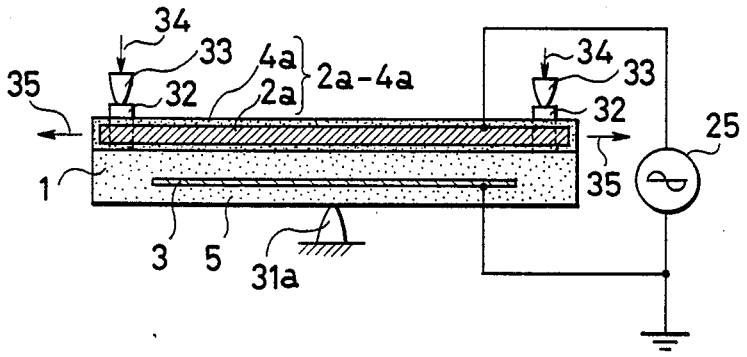

FIGS. 14 and 15 illustrate another embodiment of the present invention in which the combined wire electrode 2a–4a according to the present invention is positioned in close contact with the surface of the insulating thin plate 1. FIG. 15 is a cross-sectional view taken along the line B—B in FIG. 14. This embodiment is achieved for the purpose of overcoming a problem that, when the diameter of the combined wire electrode 2a–4a is small, the relative relationship between this and the surface of the insulating thin plate 1 becomes difficult to be maintained constant through the overall length of the electrode. Referring to FIGS. 14 and 15, the combined wire electrode 2a–4a is, at the two ends thereof, positioned in close contact with the surface of the insulating thin plate 1 by a fastener 32 under a certain tension 35 applied to the combined wire electrode 2a–4a in the lengthwise direction thereof. In this state, the overall body of the discharge element is supported from lower portion by a fixed blade type of supporting point 31a, and is applied with a downward force 34 by abutting members 34 disposed at the two ends of the combined wire electrode 2a–4a. Therefore, the whole body of the discharge element is slightly and upwardly bent so that the combined wire electrode 2a–4a is brought into close contact with the surface of the insulating thin plate 1 through the entire length of the same. As a result of this, a uniform discharge can be realized. The structures shown in FIGS. 11 to 15 are not limited to the illustration, but they can be variously modified. For example, the insulating thin plate 1 is not limited to be in the form of a flat plate. It may be, as shown in FIG. 9, designed in the form of a thin thickness cylindrical insulating body including planar electrode 3 to which a plurality of combined wire electrodes are wound in parallel to form an annular shape. Another structure may be employed in which they may be wound to form a parallel shape. Furthermore, if the diameter of the cylindrical insulating body is small, a combined wire electrode is provided in parallel to the cylinder, and the cylindrical insulating body is slightly bent so as to realize close contact with the combined wire electrode. As described above, various embodiments can be employed within the scope of the present invention. Furthermore, in a case of a cylindrical insulating body, the planar electrode may be disposed on the outside of the cylinder while the combined wire electrode may be disposed on the inside surface of the cylinder. In this case, elasticity involved by the combined wire electrode can be used to realize close contact with the cylindrical insulating body.

Figure 16:
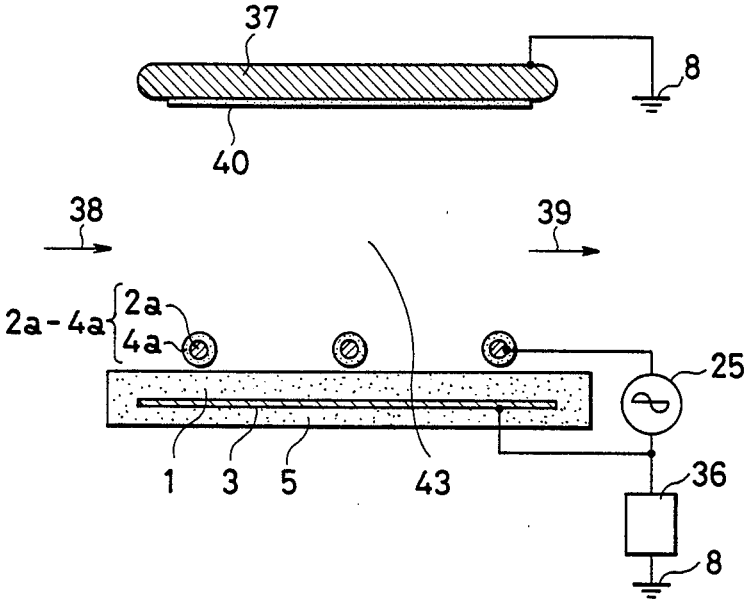
FIGS. 16 to 18 illustrate the structure of a case where the discharge element according to the present invention is applied to a charge or a discharge apparatus.

FIG. 16 illustrates the basic structure of a system according to the present invention wherein the discharge element as in detail described above is subject to an ion generating apparatus, a charge apparatus, a discharge apparatus or the like. The discharge element used in FIG. 16 may comprise the same illustrated in FIGS. 11 to 15, but it can comprise that of the type described in FIGS. 1 to 6. In principle, the type shown in FIGS. 11 to 15 is capable of generating a great quantity of ions only with a low voltage when it is operated in the air atmosphere, and furthermore generation of ozone is limited. Therefore, the discharge element of this type is usually used for the purpose of generating ions, charging and discharging. On the other hand, the discharge element of the type illustrated in FIGS. 1 to 6, in principle, has characteristics suitable for discharge chemical applications such as generating ozone. Referring to FIG. 16, AC silent creeping discharge having a certain relationship with the power source frequency is generated on the surface of the discharge element adjacent to the combined wire electrode 2a–4a due to non-uniform AC electrical field generated by the AC power source. Therefore, plasma formed by positive and negative ions and electrons are periodically generated. Therefore, when a potential determining power source 36 is disposed between, for example, the discharge element and the earth 8 and an opposing electrode 37 is disposed in such a manner that the same is grounded opposing the discharge element, an electrical field is generated between the discharge element and the opposing electrode due to the polarity of the potential determining power source 36 and the voltage of the same. As a result of this, ions having a specific polarity are discharged from the above-described plasma and fly through a space 43 toward the opposing electrode 37. For example, if a negative DC poWer source is used as the potential determining power source 36, negative ions are discharged from the discharge element; if a positive DC power source is used, positive ions are discharged; and if an AC power source is used, both positive and negative ions are alternately discharged toward the space 43. In this case, the frequency of the power source 36 needs, in principle, to be lower than that of the power source 25. As described above, the apparatus serving as the ion generator and according to the present invention can widely adjust the quantity of ions generated by adjusting the power source 25. Individually from this characteristic, it has a significant characteristic that the strength of the electrical field where ions are present and the polarity of the ions can be freely selected. Furthermore, as described in FIGS. 1 to 5, it exhibits a long life and wide operating scope as a practical apparatus due to its characteristics. With the ion generating apparatus shown in FIG. 16, when a DC power source having a predetermined polarity is used as the potential determining power source 36 and fine particles or particles are passed at a high speed as designated by arrows 38 and 39, they can be charged to a predetermined polarity. Therefore, it can be used as a charge apparatus. Similarly, when articles are passed as designated by the arrows 38 and 39 when an AC is used as the potential determining power source 36, the articles are to be subjected alternately to a quantity of positive and negative ions. Therefore, it can be used as a high performance discharge apparatus. When solid or liquid particles are slowly passed through the space 43, it can be used as a high performance electric dust collector or a static painting apparatus utilizing both charging capability and Coulomb force. In this case, reference numeral 37 represents a dust collecting electrode or an article to be painted, and reference numeral 40 represents a dust layer to be collected or paint layer to be painted. By arranging in such a manner that the opposing electrode 37 comprises an electrically conductive base of an electronic copying machine and reference numeral 40 represents a high resistance photosemiconductor layer formed on the former, it can be used as a charge apparatus for semiconductor layers, a transferring charge apparatus, or a discharge apparatus giving significant advantages such as that high speed electronic copying machine can be realized, gradation can be moderated, and the service cycle can be lengthened. The electrically conductive base 37 for the electronic copying machine and the high resistance semiconductor layer 40 usually move in parallel in the directions designated by arrows 38 and 39 and they are not limited to a flat shape, but can comprise a cylindrical shape and other shapes at needs. Assuming that particles are present, the application of the present invention to a charge apparatus gives a significant advantage in that the gathering and adhesion of particles to the electrode can be essentially prevented due to repulsive action of particles in the non-uniform electrical field formed between the combined wire electrode 2a and 4a and 3. The effect of the type described above is a significant characteristic of the present invention. Although the conventional apparatus shown in FIGS. 20 to 21 claim such characteristics, it can be first realized as the practical industrial apparatus thanks to the lengthening of the life of the combined strip electrode and the combined wire electrode according to the present invention.

Figure 17:
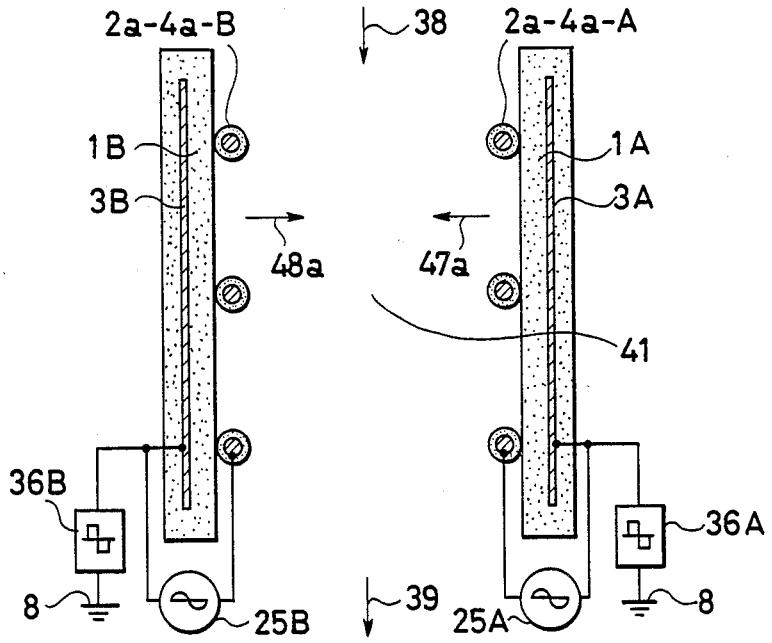
Figure 18:
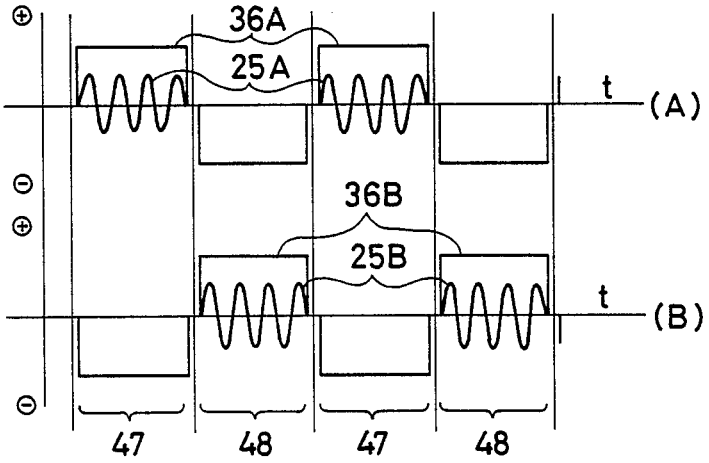

FIG. 17 illustrates an embodiment of an apparatus capable of charging or discharging articles symmetrically from two sides of the same. Referring to FIG. 17, when power source 25A, 36A, 25B and 36B are operated keeping the time periodical relationships shown in FIG. 18, ions are discharged from an element 2a–4a–A in the direction designated by an arrow 47a in a half cycle 47, while ions are discharged from an element 2a–4a–B in the direction designated by an arrow 48a in a half cycle 48. In both half cycles, the polarity of the ions discharged becomes positive so that an article passing through a space 41 between the arrows 38 and 39 can be charged from two sides by ions of the same polarity. Furthermore, since the average potential of the element can be always maintained zero, the article cannot be attracted to either of the element due to Coulomb force. Therefore, such structure exhibits significantly high performance at the time of charging high resistance articles. In particular, when the polarity of charge is intended to be negative, the relative relationships between 36A and 25A and between 36B and 25B need to be delayed by a half cycle. Furthermore, by always operating 25A and 25B, positive and negative ions are alternately discharged from the two discharge elements every half cycle. Therefore, such structure can be used as a strong discharge apparatus.

Figure 19A:
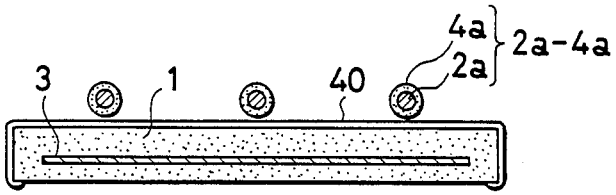
FIG. 19 illustrates the smoothing of the surface of the discharge element according to the present invention.
Figure 19B:
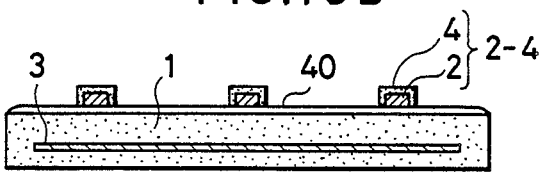
Figure 19C:
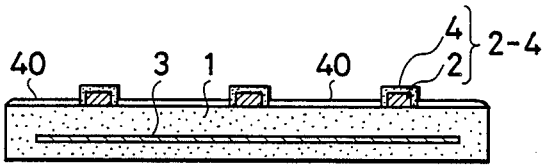

FIG. 19 illustrates an embodiment in which contamination of the surface of the insulating material of the discharge element according to the present invention is prevented. In principle, as the smoothness of the surface of the insulating material of the discharge element according to the present invention increases, the quantity of dust or the like contained in the gas becomes reduced Therefore, the surface sometimes needs to be smoothed by fusing or the like with a grinding laser. In addition to this, a grazing treatment and grading treatment may be employed. As shown in FIGS. 19A and 19B, the structure may be formed in such a manner that after applying a smoothing treatment to the whole body of the insulating material, which the wire electrode 2a–4a and the line electrode 2–4 are provided Furthermore, the structure may be formed in such a manner that the smoothing treatment is applied to the portion from which the line electrode 2–4 is not present. Both of them are important embodiments of the present invention.

In the above description, the combined strip electrode 2–4 shown in FIGS. 1 to 10 and the combined wire electrodes 2a–4a and 2b–4b shown in FIGS. 11A and 11B to 17 are all called collectively a linear electrode.

EFFECT

As described above, according to the present invention, since a high melting point ceramic semiconductor electrode is formed on the surface of the electrically conductive power supplying line so as to be served as a combined semiconductor linear electrode, when discharge is performed from the surface of this electrode toward the planar electrode, causing the temperature of this coated electrode to be raised, the coated electrode can be protected from consumption due to ion crush since it comprises high melting point ceramic semiconductor. Furthermore it cannot be melted and splashed and adhered to the surface of the ceramic insulating body. Therefore, the above-described discharge can be performed without any disorders and can be uniformly performed through the entire surface.

Furthermore, since the coated electrode comprises a high melting point ceramic semiconductor, the potential of the surface of the same can be made the same as that of the power supplying line and that of the wire electrode. Therefore, the voltage needed for performing the discharge does not need to be specially raised. Therefore, ions can be easily discharged, causing wide application to a variety of systems.

Furthermore, as described above, although the coated electrode comprises ceramic semiconductor, the inner portion comprises an electrically conductive power supplying line. Therefore, the current needed to cause discharge from the surface of the above-described coating to the planar electrode can be sufficiently supplied from a high potential AC power source.

Figure 20:
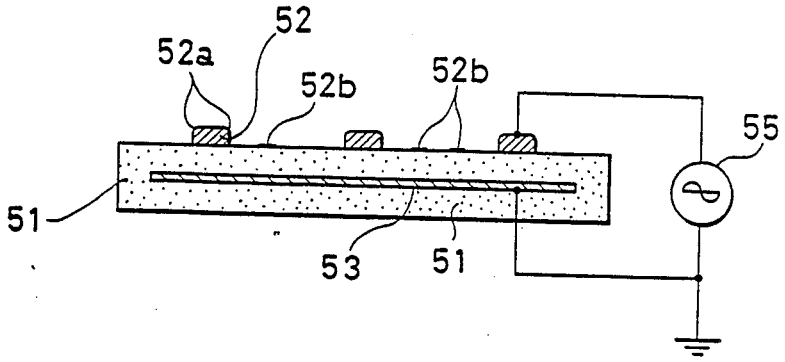
FIG. 20 (PRIOR ART)
FIG. 20 is an enlarged cross-sectional view of the portion corresponding to that of the conventional element shown in FIG. 2.
Figure 21:
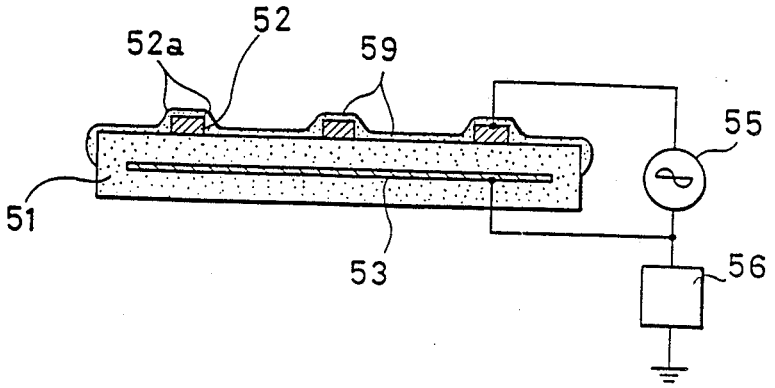
FIG. 21 (PRIOR ART)
FIG. 21 is an enlarged cross-sectional view of the portion corresponding to that of the conventional element shown in FIG. 2.

On the other hand, the conventional structure presents a critical problem, as shown in FIG. 20, that since the structure is constituted in such a manner that the surface of the ceramic insulating body 51 is provided with a metal linear electrode 52, while a planar electrode 53 is embedded inside thereof, when discharge is generated between the two electrodes 52 and 53 by a high frequency power source 55, the above-described linear electrode 52 is consumed due to high temperature, and molten materials splash to the surface of the ceramic insulating body 51 so that an adhesion material **52*b* is formed, causing the performance to deteriorate in a short time due to the disorder of the above-described electrical field. Furthermore, since such splash of the linear electrode 52 mainly occurs at a periphery portion 52*a* thereof, the curvature of this portion becomes enlarged, causing the electrical field to be weakened. As a result of this, discharge becomes difficult to be generated. The performance is also deteriorated due to this phenomenon, and these causes act together to intensely prevent realization of a structure capable of being used in the industrial field. In order to overcome these problems, a measure is disclosed in which grazing or grading layer 59 is provided on the surface of it. However, at the time of performing the grading treatment, the curvature of the electrode peripheral portion 52*a* becomes large due to melding of the grading material. It leads to a fact that discharge becomes difficult to be generated, and simultaneously, air bubbles become easy to be formed in the peripheral grading layer. It leads to a fact that the grading layer diminishes in a relatively short operating period and the inner linear electrode 52 appears outside. As a result of this, performance will rapidly deteriorate. Furthermore, when high frequency creeping discharge is generated by the high frequency power source 55, and then the ions to be used are discharged from the surface of the element by the action of the power source 56, a critical problem arises that, since the grading material usually comprises an insulating material, an electrical charge of the opposite polarity to the thus-discharged ions is stocked on the surface, causing the continuous discharge of ions to become difficult. Even if the linear electrode 52** is replaced by a semiconductor such as ceramics, a practical apparatus cannot be obtained due to heating of the electrode and reduction in the voltage applied to the electrode in the lengthwise direction of the electrode.

What is claimed is:

1. A discharge element comprising:

a planar electrode;

at least one high melting point semiconductor linear electrode having incorporated therein an electrically conductive element of high current carrying capacity, said semiconductor portion of said linear electrode surrounding said electrically conductive element; and a ceramic insulating body disposed between said planar electrode and said at least one linear electrode, said ceramic insulating body having a first and a second major surface.

2. A discharge element according to claim 1, wherein said ceramic insulating body is selected from the group consisting of a thin flat plate, a thin cylinder, and a predetermined shaped thin plate, wherein said first major surface of said insulating body is provided with a planar electrode, and wherein said second major surface of said insulating body is provided with at least one high melting point semiconductor linear electrode containing an electrically conductive element of high current carrying capacity, said semiconductor portion of said linear electrode surrounding said electrically conductive element.

3. A discharge element according to claim 1 wherein said high melting point semiconductor linear electrode is selected from the group consisting of at least one compound of titania, silicon carbide, zirconia, ceria and mixtures thereof.

4. A discharge element according to claim 2, wherein said high melting point semiconductor is selected from the group consisting of at least one compound of titania, chromia, silicon carbide, zirconia, ceria and mixtures thereof.

5. A discharge element according to any of the claims 1 or 3, wherein said high melting point linear electrode is formed in a thin line, and a gap having a substantially predetermined distance is provided between the surface of said thin line linear electrode and said ceramic insulating body.

6. A discharge element according to any of claims 1, 2, 3, or 4, wherein said high melting point linear electrode is formed in a thin line, and said thin line linear electrode is positioned in contact with said second major surface of said ceramic insulating body.

7. A discharge element according to any of claims 1, 2, 3, or 4, wherein said high melting point linear electrode is formed in a a thin line, and said thin line electrode has means for positioning in close contact with said second major surface of said ceramic insulating body.

8. A discharge element according to any of claims 1 or 3, wherein means is provided to adjust the distance between said high melting point linear electrode and said second major surface of said ceramic insulating body.

9. A discharge element according to any of claims 1, 2, 3, or 4, wherein said planar electrode is coated with an insulating material layer; and said high melting point linear electrode is formed in a thin line.

10. A discharge element according to claim 9, wherein said planar electrode is coated with an insulating material layer which is compositionally the same as said ceramic insulating body.

11. A discharge element according to claim 9, wherein said ceramic insulating body is provided with a connecting hole for connecting said first major surface and said second major surface.

12. A discharge element according to claim 10, wherein said ceramic insulating body is provided with a connecting hole for connecting said first major surface and said second major surface.

13. A discharge element comprising:

at least one high melting point semiconductor linear electrode having incorporated therein an electrically conductive element of high current carrying capacity, said semiconductor portion of said linear electrode surrounding said electrically conductive element;

a planar electrode;

a ceramic insulating body disposed between said at least one high melting point linear electrode and said planar electrode; and a high potential AC power source disposed between said at least one high melting point linear electrode and said planar electrode so that silent creeping discharge is generated.

14. A discharge apparatus according to claim 13, wherein a heat radiation means is provided for said planar electrode.

15. A discharge apparatus according to claim 13, wherein said planar electrode is coated with an insulating material layer.

16. A gas discharge treatment apparatus comprising:

a discharge element;

a discharge chamber; and a high potential AC power source;

said discharge element comprising at least one high melting point semiconductor linear electrode including an electrically conductive element of high current carrying capacity, wherein the semiconductor portion of said linear electrode surrounds said electrically conductive element; a planar electrode; and a ceramic insulating body disposed between said at least one high melting point linear electrode and said planar electrode;

said discharge chamber is disposed on the surface of said ceramic insulating body on which said high melting point linear electrode is provided;

a treatment gas discharge port is disposed in said discharge chamber; and said high potential AC power source is disposed between said at least one high melting point linear electrode and said planar electrode so that silent creeping discharge is generated.

17. A gas discharge treatment apparatus according to claim 16, wherein said discharge chamber includes the overall body of said discharge element.

18. A gas discharge treatment apparatus according to claim 16, wherein said discharge chamber including said treatment gas discharge port is disposed on the surface of said ceramic insulating body adjacent to said linear electrode, and said ceramic insulating body includes a treatment gas gathering port disposed on the surface of said ceramic insulating body adjacent to said planar electrode.

19. A gas discharge treatment apparatus according to claim 16, wherein said ceramic insulating body is shaped in the form of thin cylinder.

20. A gas discharge treatment apparatus according to claim 16, wherein said discharge chamber is formed by providing a plurality of high melting point linear electrodes in such manner that the surfaces thereof are separated and opposed to each other and by sealing the end surface thereof.

21. A gas discharge treatment apparatus according to claim 20, wherein a spacer is disposed between each of said high melting point linear electrodes.

22. An ion generating apparatus comprising a discharge element comprising at least one high melting point semiconductor linear electrode including an electrically conductive element of high current carrying capacity incorporated therein, wherein the semiconductor portion of said linear electrode surrounds said electrically conductive element; a planar electrode; and a ceramic insulating body disposed between said at least one high melting point linear electrode and said planar electrode;

means for determining and controlling the potential of said at least one high melting point linear electrode; and a high potential AC power source disposed between said at least one high melting point linear electrode and said planar electrode so that silent creeping discharge is generated.

23. An ion generating apparatus according to claim 22, wherein said potential determining and controlling means comprises an electrically conductive electrode including potential determining and controlling means disposed in the vicinity thereof and potential determining and controlling means connected to said discharge element.

24. A charge or discharge apparatus comprising a discharge element comprising at least one high melting point semiconductor linear electrode including an electrically conductive element of high current carrying capacity incorporated therein, wherein the semiconductor portion of said linear electrode surrounds said electrically conductive element; a planar electrode; and a ceramic insulating body disposed between said at least one high melting point linear electrode and said planar electrode;

means for determining and controlling the potential of said at least one high melting point linear electrode comprising an electrically conductive electrode including potential and controlling means disposed in the vicinity thereof and potential determining and controlling means connected to said discharge element;

means for introducing or delivering articles between said discharge element and said electrically conductive electrode; and a high potential AC power source disposed between said at least one high melting point linear electrode and said planar electrode so that silent creeping discharge is generated.

25. A charge or discharge apparatus according to claim 24, further comprising at least two ion generating electrodes and high potential AC power sources for said at least two ion generating electrodes, wherein said electrically conductive electrode is included as one of said ion generating electrodes, and said high potential AC power sources for said at least two ion generating electrodes are alternatively operated and the position of at least one of said ion generating electrodes is so arranged that the potential during operation of the same is maintained at a predetermined level with respect to at least one other ion generating electrode which is not being operated.

26. An apparatus according to claim 25, wherein said high potential power sources for said at least two ion generating electrodes are simultaneously operated so that the relative potential of said at least two ion generating electrodes are periodically switched.

* * * * *

UNITED STATES PATENT AND TRADEMARK OFFICE

CERTIFICATE OF CORRECTION

PATENT NO. : 4,975,579

DATED : December 4, 1990

INVENTOR(S) : Masao Iwanaga

It is certified that error appears in the above-identified patent and that said Letters Patent is hereby corrected as shown below:

Column 1, line 13:
After "oxidents" insert -- . --.

Column 1, line 42:
"liner" should be -- linear --.

Column 3, line 31:
"the" should be -- them --.

Column 5, line 23:
After "intended" insert -- . --.

Column 5, line 27:
After "employed" insert -- . --.

Column 5, line 31:
After "point" insert -- . --.

Column 7, line 25:
After "descriptions" insert -- . --.

Column 7, line 53:
"use." should be -- used. --.

Column 9, line 39:
"b" should be -- by --.

Column 11, line 16:
"poWer" should be -- power --.

Column 11, line 33:
"5" should be -- 15 --.

Column 12, line 53:
Before "which" insert -- after --.

Column 12, line 54:
After "provided" insert -- . --.

UNITED STATES PATENT AND TRADEMARK OFFICE

CERTIFICATE OF CORRECTION

PATENT NO. : 4,975,579

DATED : December 4, 1990

INVENTOR(S) : Masao Iwanaga

It is certified that error appears in the above-identified patent and that said Letters Patent is hereby corrected as shown below:

Column 14, line 56:
"aa" should be -- a --.

Signed and Sealed this

Fourth Day of August, 1992

*Attest:*

DOUGLAS B. COMER

*Attesting Officer*

*Acting Commissioner of Patents and Trademarks*